United States Patent [19]

Harlow

[11] 3,964,729

[45] June 22, 1976

[54] ELEVATING DEVICE FOR SNOWMOBILES

[76] Inventor: Ronald Harlow, 261 Indian Trail, Columbiaville, Mich. 48421

[22] Filed: Dec. 26, 1974

[21] Appl. No.: 536,461

[52] U.S. Cl. ..... 254/131; 254/139

[51] Int. Cl.[2] ..... B66F 3/00

[58] Field of Search ..... 254/120, 131, 133, 127, 254/47, 4 R, 4 B, 4 C, 139, 139.1, 146

[56] References Cited

UNITED STATES PATENTS

| | | | |
|---|---|---|---|
| 231,495 | 8/1880 | Morris | 254/47 |
| 791,969 | 6/1905 | Wiley | 254/139 |
| 1,574,395 | 2/1926 | Howe | 254/131 |
| 2,439,122 | 4/1948 | Baker | 254/131 |
| 2,648,521 | 8/1953 | Sales | 254/47 |

*Primary Examiner*—Al Lawrence Smith
*Assistant Examiner*—Robert C. Watson
*Attorney, Agent, or Firm*—Basile and Weintraub

[57] ABSTRACT

An elevating device for snowmobiles and like vehicles includes a base support and a pair of upstanding support posts. A belted vehicle engaging means has one end thereof secured to a lever which is rotatably secured to the support posts.

9 Claims, 6 Drawing Figures

ELEVATING DEVICE FOR SNOWMOBILES

BACKGROUND OF THE INVENTION

1. Field of the Invention

The present invention pertains to elevating devices. More particularly, the present invention pertains to elevating devices for vehicles. Even more particularly, the present invention concerns elevating devices for snowmobiles and like vehicles.

2. Prior Art

There has recently developed a tremendous interest in the use of recreational vehicles and, in particular, snowmobiles and similar vehicles. Yet, with the expanding use and enjoyment of such vehicles there has been developed certain problems which have not been alleviated.

One of the more frequently encountered problems involved with such vehicles resides in the elevating of such vehicles. Normally, in cleaning, servicing and repairing such vehicles it is necessary to elevate the vehicle and, usually, about the track section thereof. Heretofore, however, the lifting of the vehicle involved the manual elevating thereof. This often results in unnecessary pulling, lifting, backaches and strains.

Furthermore, during periods of nonuse of such vehicles it is necessary to lift the track section thereof off of the ground surface. This not only requires the same enumerated operations but, again, creates the same unnecessary hazards. Additionally, support structures, such as a platform, is, also, required to maintain the the track section in its elevated position.

The present invention, as will become apparent, subsequently, eliminates these problems by providing a compact, lightweight, elevating device adapted for elevating such vehicles.

SUMMARY OF THE INVENTION

In accordance with the present invention there is provided an elevating or hoisting device. The device is specifically adapted for lifting the track section of snowmobiles and other similar vehicles.

The device hereof generally comprises a base support and upright support means comprising a pair of spaced apart upstanding support members extending upwardly therefrom. A roller is mounted to the support means and is secured thereto. A vehicle grasping means passes over the roller and has a first free end. The second end of the grasping means is secured to a rotatable lever rotatably mounted between the support means.

The lever is an over center lever wherein rotation thereof past the center of gravity of the device provides positive locking of the vehicle grasping means.

In an alternate embodiment of the device hereof, apertured brackets are secured to the support means. The roller and lever are adjustably mountable onto their associated brackets to provide means for adjusting the positions thereof.

The device hereof can, also, be effectively utilized in lifting boat trailers, automobiles and the like.

For a more complete understanding of the present invention reference is made to the following detailed description and accompanying drawing. In the drawing like reference characters refer to like parts through the several views, in which:

DESCRIPTION OF THE PREFERRED EMBODIMENTS

Figure 1:
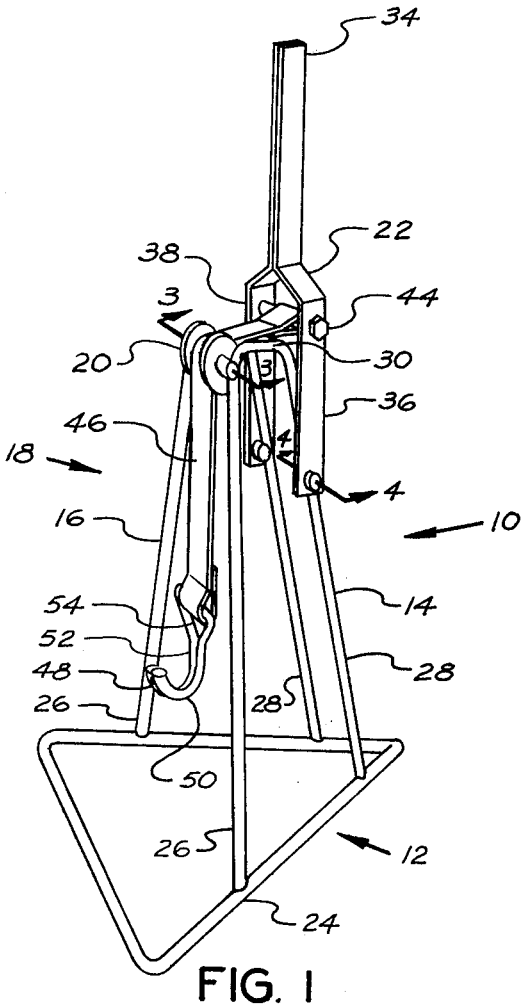
FIG. 1 is a perspective view of a first embodiment of the instant invention shown in a first position.
Figure 3:
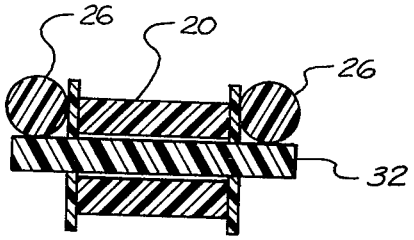
FIG. 3 is a cross-sectional view taken along the line 3—3 of FIG. 1.
Figure 2:
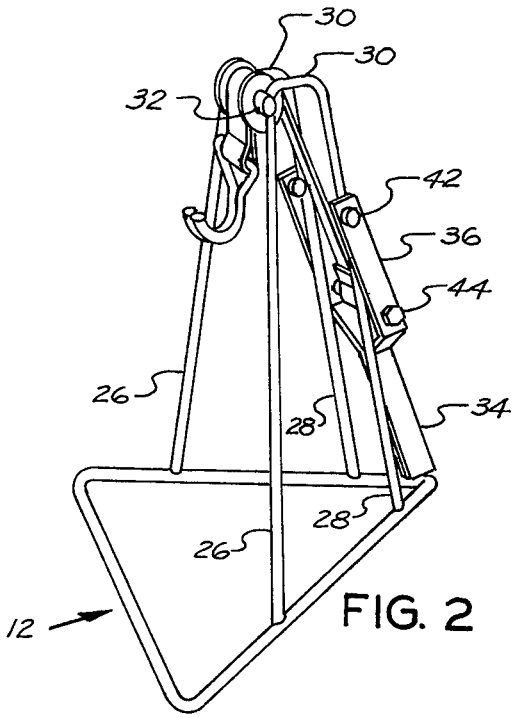
FIG. 2 is a perspective view of the first embodiment of the instant invention shown in a second position.
Figure 4:
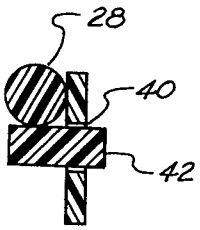
FIG. 4 is a cross-sectional view taken along the line 4—4 of FIG. 1.

Now with reference to the drawing, and in particular, FIGS. 1–4, there is depicted therein a first embodiment of the present device, generally indicated at 10. The device 10 generally comprises a base support 12, and a support means, such as a pair of spaced apart support members or posts, 14, 16, respectively. The device 10, also, comprises vehicle grasping or engaging means 18. The means 18 passes over a roller 20 and is secured at one end thereof to a rotatable lever 22.

Now, with more particularly, the device 10 hereof contemplates a base support structure 12. The structure 12 is a substantially planar member which is ground surface engaging. The structure 12 can assume any geometric configuration, but the triangular member 24 is preferred.

Secured to the edges of the base support 12 is the support means. The support means comprises a pair of upstanding support members or posts 14, 16, respectively. Each support member extends substantially vertically upwardly from the base support 12. Preferably, each support member 14, 16 comprises a substantially inverted U-shaped member having the free ends of their respective legs 26, 28 fixedly secured to the base support 12, such as by welding or the like.

To provide rigidity to the support members 14, 16, each first or forward leg 26 is angularly inclined both longitudinally and laterally, by angles $\theta$ and $\phi$, respectively, rather than being exactly vertically extending. This angular disposition minimizes the shear forces applied to the device, thus, preventing the device from collapsing under the force applied by an elevated vehicle. Each second or rearward leg 28 of each post is, also, longitudinally inclined.

Each U-shaped member 14, 16 also includes a horizontally extending connecting leg 30.

A roller 20 extends between the two forward legs 26. The roller 20 is rotatably mounted on an axle 32 which has its ends secured to the support members 14, 16 at the junctions of the forward legs 26 and the connecting legs 30. The roller 20 functions as both a guide means and support means for the vehicle grasping means 18, in a manner to be described subsequently.

The device 10 hereof, also, includes a lever arm 22. The lever arm 22 is rotatably mounted between the second legs 28 of the support posts 14, 16. The lever arm generally comprises a Y-shaped member having a handle 34 and a pair of legs 36, 38 extending therefrom.

Each leg 36, 38 is provided with an aperture 40 through which is disposed a pivot pin 42. Each pivot pin 42 is fixedly secured to their associated second leg 28, such as by welding or the like. In this manner the lever arm pivotally rotates about the pivot pins between the positions shown in FIGS. 1 and 2, respectively.

Traversing the space between the legs 36, 38 is a bar 44. The bar 44 has secured thereto one end of the grasping means 18.

The grasping means 18 comprises an elongated belting 46 having one end thereof overlapping the bar 44 and which is stitched to or otherwise secured to itself. The belting extends from the bar 44 over the roller 20 which thereby guides the belting. The other end of the belting 46 is secured to a hook 48 in a manner similar to that used to secure the belting to itself about the bar 44.

Although the belting can be formed from any suitable material, it is preferred that the belting be formed from nylon. It has been found that if the vehicle, when hoisted, has its engine running the nylon tends to dampen, and thereby, minimize any vibrations.

Figure 5:
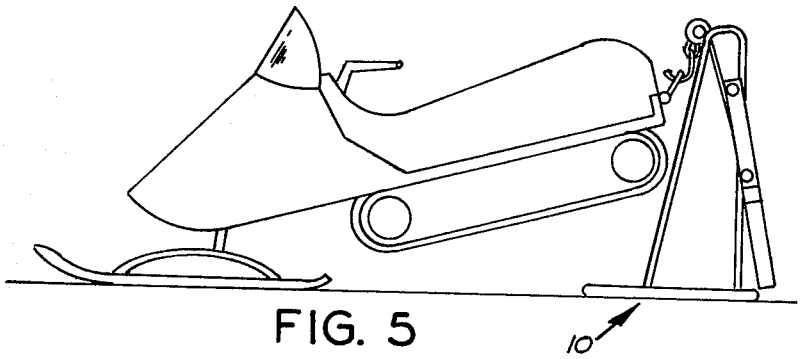
FIG. 5 is a side elevational view showing deployment of the instant invention.

The hook 48 is adapted to engage the bumper of a vehicle, such as the rear bumper of a snowmobile, as shown in FIG. 5. The hook 48 comprises a J-shaped member having an arcuate section 50 which is vehicle engaging and a linear section 52. The linear section 52 is provided with an opening 54 through which the belting 46 is overlapped in the manner heretofore described.

In deploying the present device 10 the hook 48 is engaged with the vehicle bumper or other suitable position and the lever arm is then rotated between the upper and lower positions to elevate the vehicle (FIG. 5).

Figure 6:
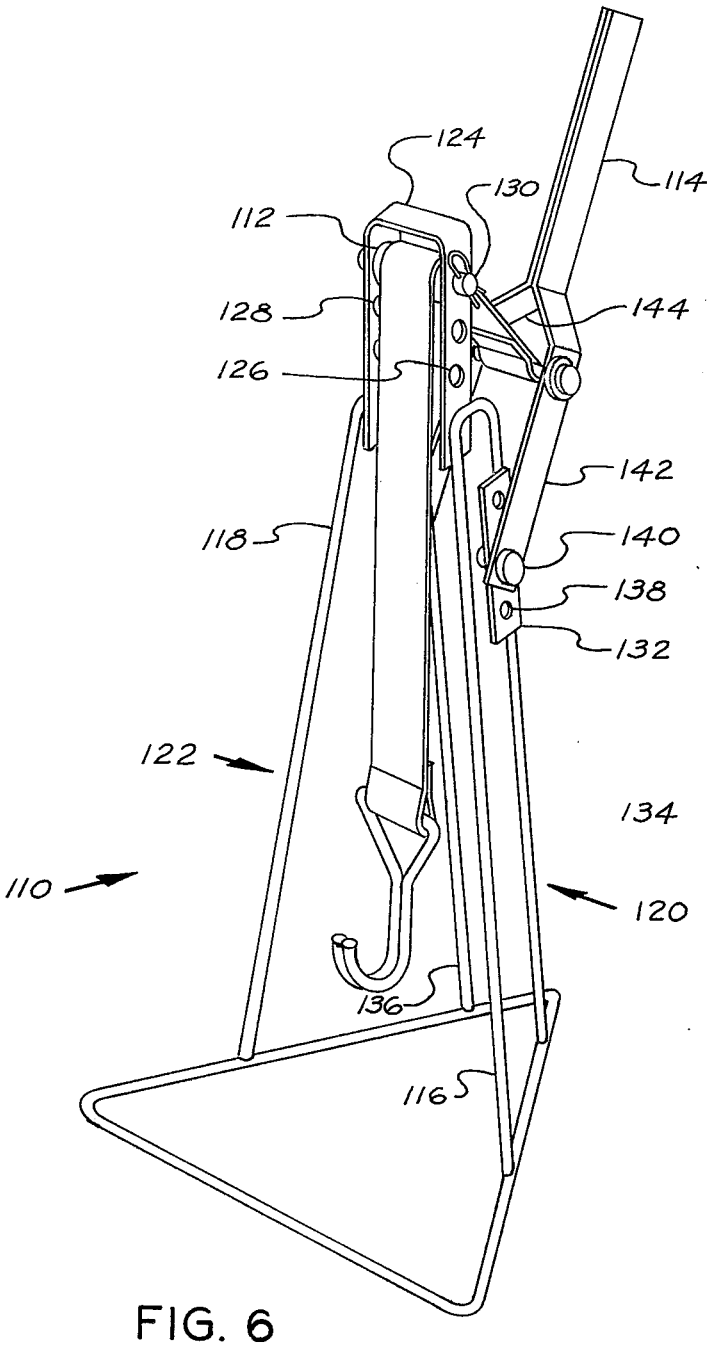
FIG. 6 is a perspective view of an alternate embodiment of the present invention.

Referring now to FIG. 6, there is depicted therein an alternate embodiment, generally indicated at 110, of the present invention. According to this embodiment the positioning of the roller 112 and lever arm 114 are rendered positionably vertically adjustable.

In accordance herewith, each forward leg 116, 118 of each inverted U-shaped support member 120, 122, respectively, has secured thereto a U-shaped mounting bracket 124. The bracket is rigidly secured to the respective legs by welding or the like and extend vertically upwardly therefrom. The bracket is substantially parallel to each other.

The bracket is provided with a plurality of apertures 126, 128 disposed therealong. Each one aperture 126 of bracket 124 is in registry with one aperture 128 of bracket 124. In this manner there is provided a plurality of pairs of spaced apart registering apertures, such that the mounting bracket defines means for adjusting the position of the roller 112.

The roller 112 is constructed in the same manner defined with respect to the first embodiment. The roller 112 is rotatably mounted on an axle 130. In mounting the roller 112, the ends of the axle 130 are inserted into any one pair of registering apertures 126, 128. Thus, by positioning the ends of the axle in this manner, the roller is rendered height adjustable.

As hereinbefore noted, the lever arm 114 is, also, adjustably positionable. To this end, a mounting bracket 132 is affixed to each second leg 134, 136 of the support posts 120, 122 and only one bracket being shown. The bracket 132 is secured to the associated legs, such as by welding or the like, and extend vertically upwardly therefrom. The brackets are substantially parallel to each other. Each bracket is provided with a plurality of apertures 138 disposed therealong. Each one aperture 138 is in registry with one aperture on the other bracket. Thus, there is provided pairs of spaced apart registering apertures such that the mounting brackets 132 cooperate to define means for adjusting the height of the lever arm 114.

With respect to the lever arm, per se, it is fabricated substantially the same as that described with reference to the first embodiment of the invention. However, and in accordance herewith, pivot pins 140 are rigidly affixed to their associated legs 142, 144 of the lever arm. The pivot pins 140 are axially aligned and are secured to their respective legs such as by welding or the like. In adjusting the height of the lever arm 114, the pivot pins are inserted through any one pair of registering apertures provided on the mounting brackets 132. Hoisting of a vehicle is accomplished by the rotation of the lever arm with its pivot pins disposed in a pair of apertures.

It is, thus, seen that by the present embodiment the roller and the lever arm are height adjustable.

In fabricating the device of the present invention any suitable material can be used, such as steel rods and the like. Moreover, it should be noted that by the construction of the present device, the center of gravity is such that in rotating the lever arm downwardly past the horizontal plane positive locking is achieved since the lever arm is over the center of gravity.

It has been found that the present device is capable of lifting about seventy times its own weight. Moreover, and although not illustrated in the drawing, it is possible to mount wheels at the corners of the base support.

It should also be noted that the present device can be used for elevating boat trailers and small automobiles and the like, in addition to snowmobiles.

Having thus described the invention, what is claimed is:

1. A vehicle elevating device, comprising:
   a. a ground engaging base support,
   b. an upstanding support means secured to the base support, the support means comprising;
   a pair of spaced apart inverted U-shaped support members, each having a first leg, a second leg and a connecting leg,
   c. an over center rotatable lever pivotally connected to the second legs of the support means,
   d. guide means secured to the first legs of the support means,
   e. vehicle grasping means secured at one end thereof to the rotatable lever and passing over the guide means, the vehicle grasping means including vehicle engaging means at the other end thereof,
   and wherein rotation of the lever arm between an upward position and a downward position elevates a vehicle in engagement with the vehicle engaging means.

2. The device of claim 1, wherein:
   each first leg is inclined both longitudinally and laterally to minimize the shear forces applied to the device.

3. The device of claim 1, wherein:
   each second leg is longitudinally inclined.

4. The device of claim 1 wherein the vehicle grasping means comprises:
   an elongated belting secured at one end thereof to the lever arm,
   the vehicle engaging means comprising a hook, the other end of the belting being secured to the hook.

5. The device of claim 1 wherein the guide means comprises a roller, and an axle, the roller being journalled on the axle, the ends of the axle being secured to the first legs of the support means.

6. The device of claim 1 which further comprises:

a. means for adjusting the height of the guide means affixed to the support means, and b. means for adjusting the height of the lever arm affixed to the support means.

7. The device of claim 6 wherein the means for adjusting the height of the guide means comprises an apertured mounting bracket, the guide means being mounted on the bracket and the means for adjusting the height of the lever arm comprises an apertured mounting bracket, the lever arm being pivotally mounted on the bracket.

8. The device of claim 1 wherein:

a. the guide means comprises a roller and an axle, the roller being journalled on the axle, the ends of the axle being secured to the support means at the junction of the first and connecting legs, and b. the vehicle grasping means comprises an elongated belting secured at one end to the lever arm and passing over the roller, the other end of the belting being secured to the vehicle engaging means.

9. The device of claim 6 wherein:

a. the means for adjusting the height of the guide means comprises an apertured U-shaped mounting bracket, one leg of which is secured to one of the first legs, one aperture of each bracket being in registry with one aperture of the other bracket, b. the guide means comprises a roller and an axle, the roller being journalled on the axle, the ends of the axle being insertable into any one pair of registering apertures, c. the means for adjusting the height of the lever arm comprising an apertured mounting bracket secured to each of the second legs, one aperture of each bracket being in registry with one aperture of the other bracket, and d. the lever arm further comprising a pair of opposed pivot pins, the pivot pins being insertable into any one pair of registering apertures to render the lever arm pivotally rotatable thereon.

* * * * *